US005376012A

United States Patent [19]

Clark

[11] Patent Number: 5,376,012

[45] Date of Patent: Dec. 27, 1994

[54] POWER PORT TERMINAL

[75] Inventor: Stephen L. Clark, Dillsburg, Pa.

[73] Assignee: E. I. Du Pont de Nemours & Co., Wilmington, Del.

[21] Appl. No.: 143,538

[22] Filed: Oct. 26, 1993

Related U.S. Application Data

[63] Continuation of Ser. No. 843,261, Feb. 12, 1992, abandoned.

[51] Int. Cl.[5] ..... H01R 13/11

[52] U.S. Cl. ..... 439/80; 439/857

[58] Field of Search ..... 439/78–81, 439/851, 852, 853, 856, 857

[56] References Cited

U.S. PATENT DOCUMENTS

| | | | |
|---|---|---|---|
| 3,026,496 | 3/1962 | Gluck | 439/851 |
| 3,083,351 | 3/1963 | Nielsen, Jr. | 439/851 |
| 4,002,400 | 1/1977 | Evans | 339/258 R |
| 4,359,258 | 4/1986 | Palecek et al. | 339/176 MP |
| 4,582,386 | 4/1986 | Martens | 339/176 M |
| 4,702,707 | 10/1987 | Hillbish | 439/80 |
| 4,749,357 | 6/1988 | Foley | 439/80 |
| 4,776,651 | 10/1988 | Paulo | 439/851 |
| 4,790,763 | 12/1988 | Weber et al. | 439/65 |
| 4,824,380 | 4/1989 | Matthews | 439/80 |
| 4,837,927 | 6/1989 | Savage, Jr. | 439/857 |
| 5,055,055 | 10/1991 | Bakker | 439/78 |
| 5,131,873 | 7/1992 | Gierut et al. | 439/851 |

OTHER PUBLICATIONS

Du Pont Interconnecting & Packaging Brochure, pp. 334–335, Aug. 1988.

Du Pont HPC Connector System Bulletin, "Meets need for reliable, high density, low insertion force interconnect systems", pp. 6, 12, 15, and 18, Jan. 1987.

*Primary Examiner*—Gary F. Paumen

*Attorney, Agent, or Firm*—Woodcock Washburn Kurtz Machiewicz & Norris

[57] ABSTRACT

A power port terminal formed by stamping from a blank of conductive material comprises a contact receiving socket portion and an integral mounting portion. The socket includes a web with a plurality of beams thereon. Each of the beams has a curved surface with a bend therein. The inner surface of the beams on the bends thereof define a substantially continuous cylindrical contact surface at a predetermined point along the reference axis of the terminal. The contact surface has a predetermined constricted dimension measured in a plane perpendicular to the reference axis, this dimension being the most constricted dimension along the reference axis of the terminal. The terminal is thereby able to accommodate a pin of any desired axial length. The trailing mounting portion has a set of mounting legs thereon that, the preferred instance, extend generally perpendicular to the reference axis of the terminal. Latch tabs may be provided one or more of the beams.

10 Claims, 4 Drawing Sheets

POWER PORT TERMINAL

This is a continuation, of application Ser. No. 07/843,261, filed Feb. 12, 1992, now abandoned.

BACKGROUND OF THE INVENTION

1. Field of the Invention

The present invention relates to a socket-type terminal for use in effecting a relatively high-amperage power connection with a male pin of any desired length.

2. Description of the Prior Art

A power port terminal for interconnecting a backplane with a male pin plug may be formed in any one of a variety of ways. U.S. Pat. No. 4,702,707 (Hillbish) illustrates a power terminal that includes a base to which a mating component having a socket may be attached. In this terminal the base and a portion of the mating component are formed as screw machined parts. U.S. Pat. No. 4,749,357 (Foley) shows a power connector in which a socket defined from a crown band of spring contact beams is inserted into a block of conductive material. In both of these arrangements the contact beams of the terminal extend around the entire 360° periphery of the male pin. However, since one end of the terminal is closed, the socket may accept a pin having only a predetermined limited axial dimension.

The power terminal shown at page 334, 335 of the DuPont Electronics Interconnect and Packaging Catalogue, August 1988, is also a machined part having a socket that may accept a pin having only a predetermined limited axial dimension. This part also includes a snap-ring latch arrangement which is received about the socket of the terminal and which cooperates with a housing to retain the terminal.

The terminal shown in U.S. Pat. No. 4,002,400 (Evans), assigned to the assignee of the present invention, is formed from a stamped blank of conductive material. Again, however, it appears that the socket portion of the terminal is blocked at an axially rearward point by a wire crimp barrel and an insulation crimp barrel, effectively limiting the axial dimension of a pin receivable in the socket.

The power terminal forming a part of the DuPont HPC Connector System, as shown at page 6 of Bulletin 712, January 1987, is fabricated from a stamped blank of conductive material. Although in this terminal the length of the pin receivable by the socket is not limited, the socket region does not fully surround the pin when the same is received therein.

In view of the foregoing it is believed advantageous to provide a socket formed from a stamped conductive material that both surrounds a male pin over substantially 360° of its periphery, and yet does not limit the axial length of pin receivable therein.

SUMMARY OF THE INVENTION

The present invention relates to a power port terminal formed by stamping from a blank of conductive material. The terminal comprises a contact receiving socket portion and an integral mounting portion. The terminal has a reference axis extending therethrough. The contact receiving socket portion includes a web with a plurality of beams thereon. Each of the beams has a curved surface with a bend therein. When the terminal is formed the beams cooperate to form an axially extending tubular socket region. The inner surface of the beams on the bends thereof define a substantially continuous cylindrical contact surface at a predetermined point along the reference axis within the tubular region. The contact surface is interrupted only by the spacing between the beams and is thus adapted to surround a male pin over 360° of its periphery. The cylindrical contact surface has a predetermined constricted dimension measured in a plane perpendicular to the reference axis, this dimension of the substantially continuous cylindrical contact surface being the most constricted dimension along the reference axis of the terminal. The terminal is thereby able to accommodate a pin of any desired axial length.

The trailing mounting portion has a set of mounting legs thereon. The mounting legs depend from the lateral flanges of a curved hood portion. The hood and flanges preferably surround substantially 270° of the periphery of the pin. In the preferred instance the mounting legs extend generally perpendicular to the reference axis of the terminal.

One or more of the beams may have a latch tab thereon. The latch tabs engage with ribs provided in the terminal housing to secure the terminal therewithin.

BRIEF DESCRIPTION OF THE DRAWINGS

The invention will be more fully understood from the following detailed description thereof taken in connection with the accompanying drawings, which form a part of this application and in which.

DETAILED DESCRIPTION OF THE INVENTION

Figure 1:
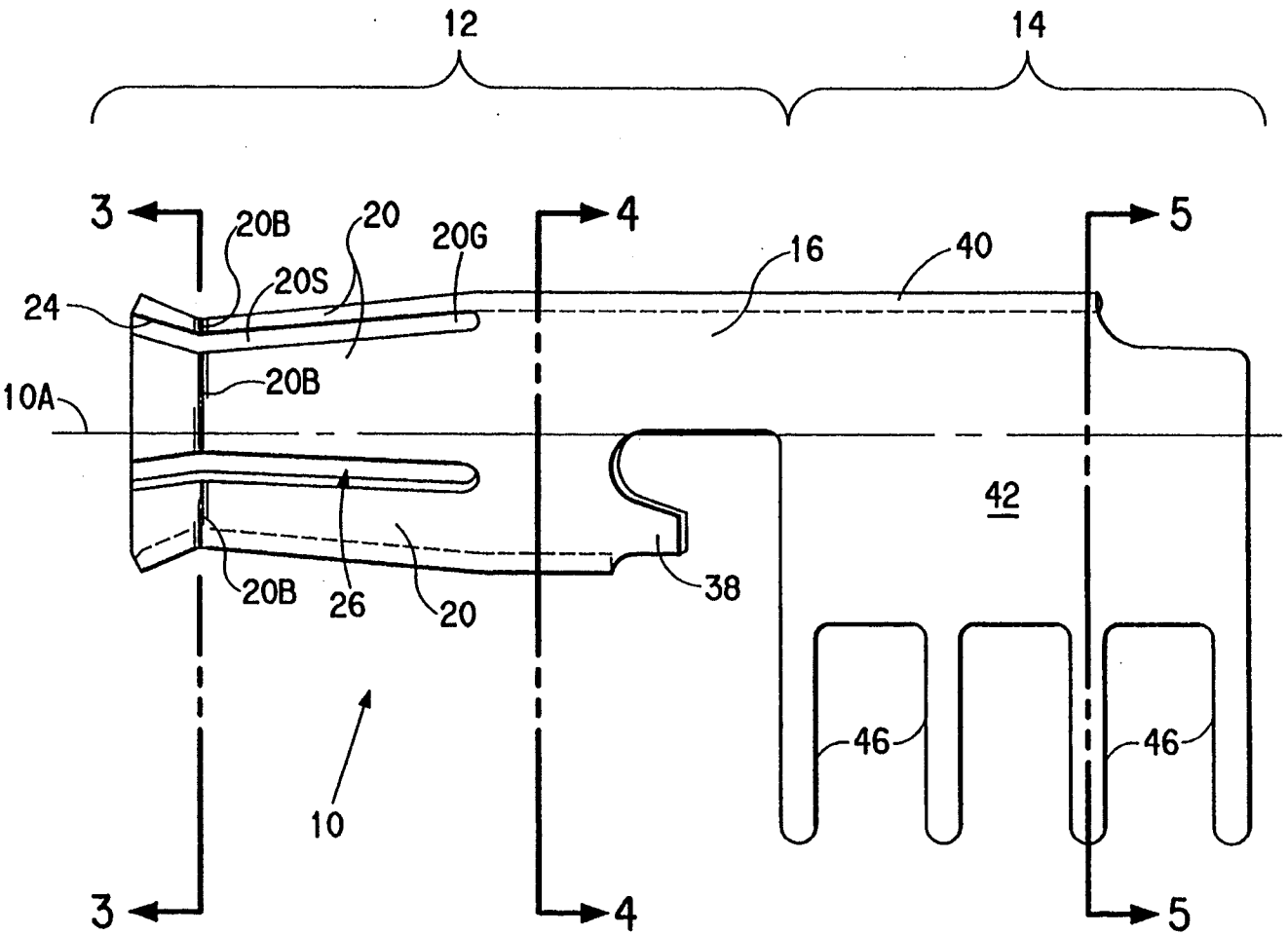
FIGS. 1 and 2 are, respectively, side and front elevation views of a power port terminal in accordance with the present invention.

Throughout the following detailed description similar reference numerals refer to similar elements in all figures of the drawings.

Figure 2:
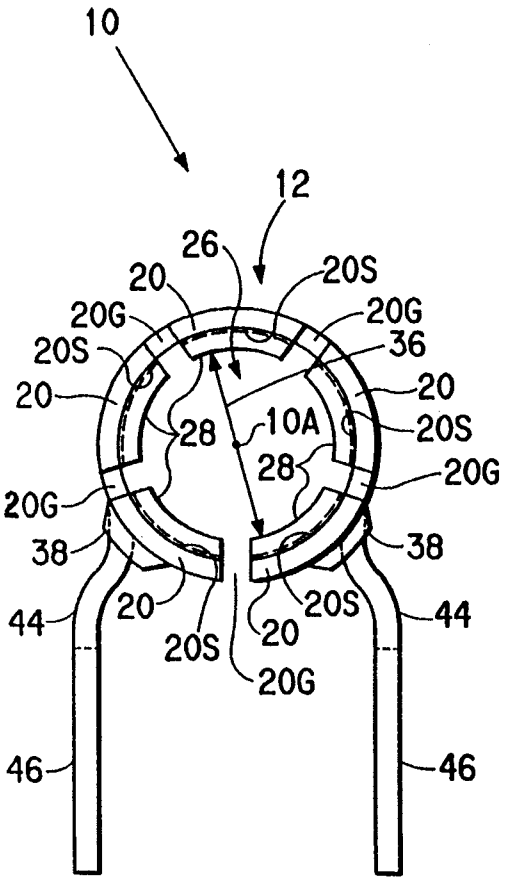
Figure 6:
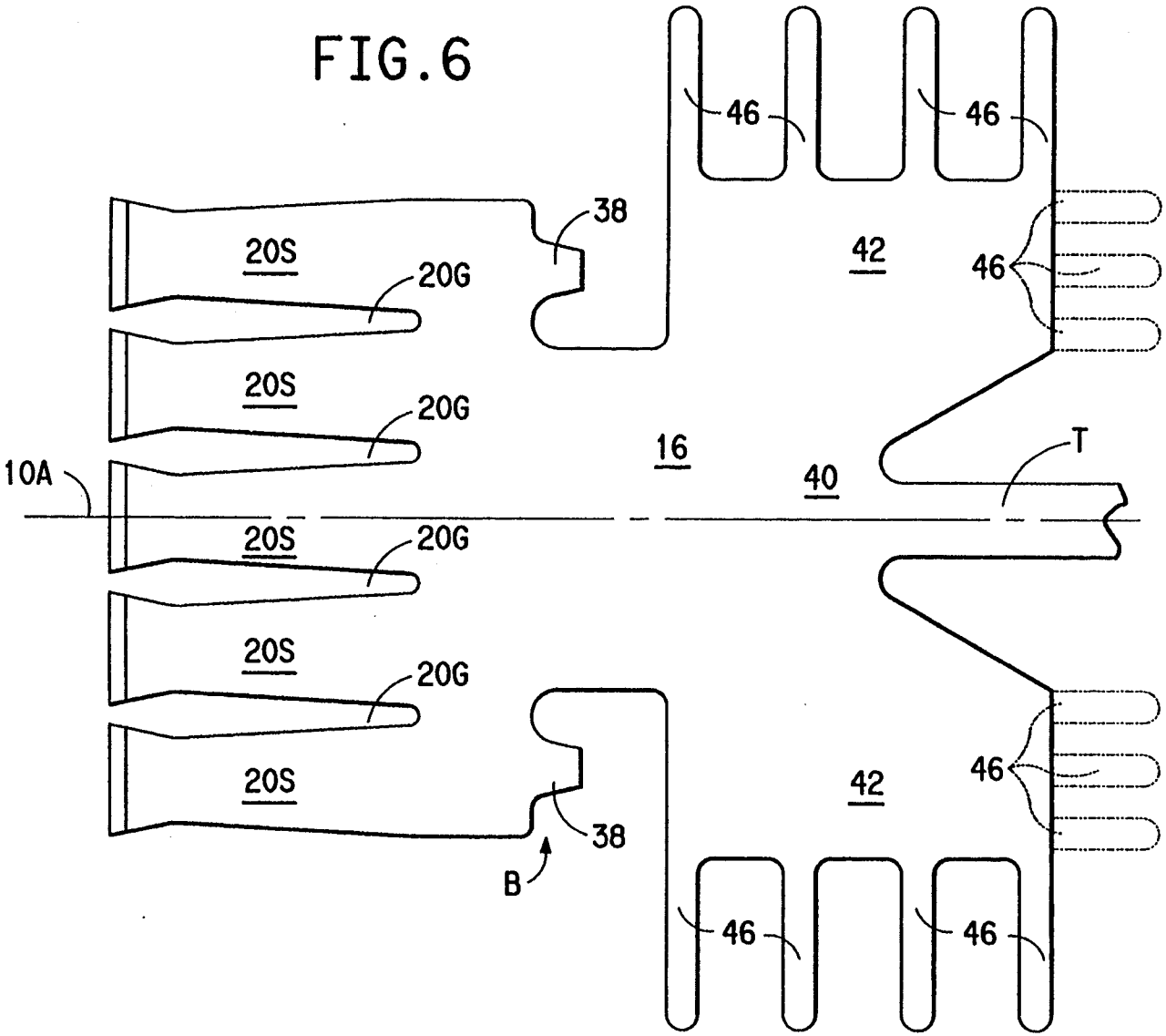
FIG. 6 is a developed plan view of a blank used to from the terminal shown in FIGS. 1 through 5.

With reference to FIGS. 1 and 2 shown is a power port terminal generally indicated by reference character 10 in accordance with the present invention. The terminal 10 is formed by stamping from a blank of a suitable conductive material, such a phoshorous bronze material. A developed view of the blank is illustrated in FIG. 6. The terminal 10 includes a contact receiving portion 12 and an integral mounting portion 14. A reference axis 10A extends through the terminal 10.

The contact receiving portion 12 includes a web 16 from which extend a plurality of beams, or fingers, 20. The beams are preferably equiangularly arranged about the axis 10A. In the embodiment illustrated five beams 20 are shown, each beam being angularly separated from the angularly adjacent beam by a gap 20G (FIG. 2). When the terminal 10 is fully formed (in a manner to be described) each of the beams 20 has a curved inside surface 20S with an inward bend 20B located axially therealong. The portion of the beams 20 forward of the bends 20B flare to define a funnel-like pin guide 24.

Figure 3:
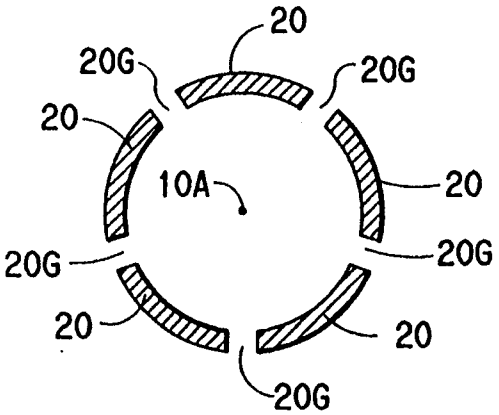
FIGS. 3, 4 and 5 are, respectively, elevational views taken in section along respective section lines 3—3, 4—4 and 5—5 in FIG. 1.

The beams 20 cooperate to form an axially extending tubular socket region 26. The socket region 26 is thus adapted to surround a male pin guided therein over 360° of its periphery. The inner surface 20S of the beams 20 at the bends 20B define a substantially continuous cylindrical contact surface 28 lying at a predetermined point 30 along the reference axis 10A within the tubular socket region 26. The contact surface 28 is, as may be best seen in FIGS. 2 and 3, interrupted only by the gap 20G between angularly adjacent beams 20.

The cylindrical contact surface 28 defined by the bends 20B of each beam 20 defines a circle centered on the reference axis 10A of the terminal. The surface 28 thus imparts a predetermined constricted dimension 36 (i.e., the diameter of the surface 28) measured in a plane perpendicular to the reference axis 10A. This dimension 36 of the substantially continuous cylindrical contact surface 28 is the most constricted dimension along the reference axis 10A of the terminal. The through bore of the socket region 26 of the terminal 10 is thus effectively unlimited. The terminal 10 is thereby able to accommodate a pin of any desired axial length.

In the preferred embodiment two of the beams 20 are provided with latch tabs 38. As may be seen in FIG. 2 the tabs 38 extend outwardly beyond the basic outer diametric dimension of the contact receiving portion 12. As an alternative it should be understood that only a single latch tab or more than two latch tabs may be provided as desired. The tabs 38 may be conveniently located on any of the beams 20. In the preferred arrangement (FIG. 6) the tab(s) 38 are formed as appendages disposed axially between the laterally outward beam(s) 20' and the mounting portion 14. The tabs 38 may be additionally or alternately formed by punching through the material of the web 16.

Figure 5:
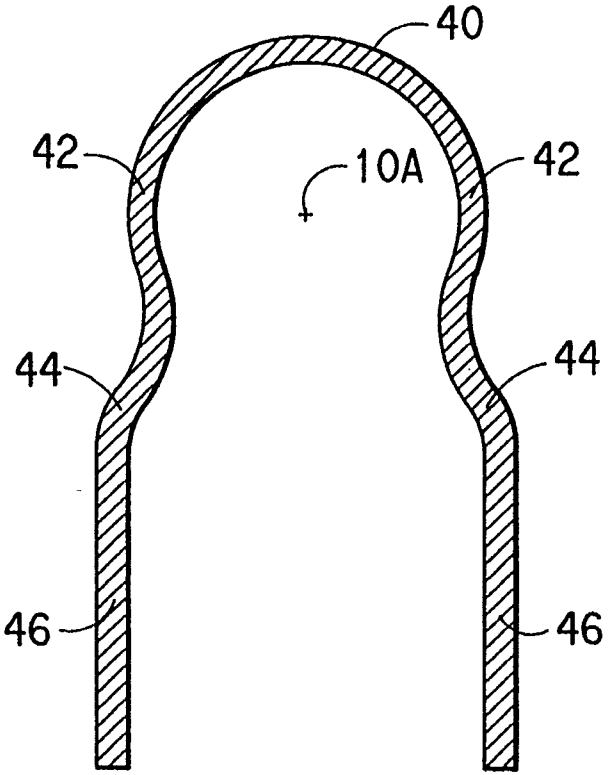
Figure 4:
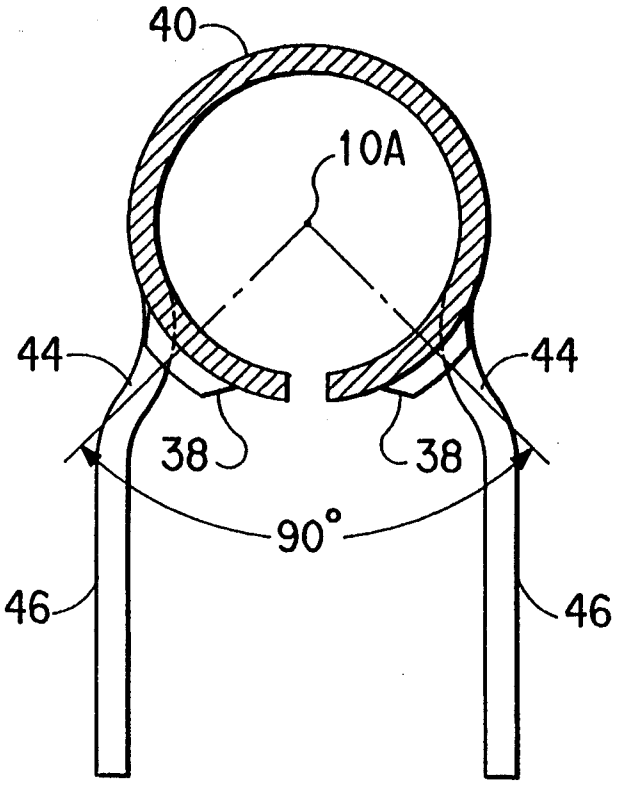

The trailing mounting portion 14 extends rearwardly from the web 16. The mounting portion 14 includes a hood region 40 melding into a pair of lateral flanges 42. As is best seen in FIG. 4 and 5 the hood 40 and the flanges 42 preferably extend substantially 270° about the reference axis 10A of the terminal 10. The flanges 42 are bent outwardly, as at 44. A plurality of mounting legs 46 depending from each flange 42 defines a set of mounting legs for the terminal 10. The mounting legs 46 each extend downwardly a substantial distance below the contact receiving portion 12.

In the preferred embodiment, the mounting legs 46 extend generally perpendicularly to the reference axis 10A of the terminal. The mounting legs 46 may be received by plated through bores provided in the surface of a substrate whereby electrical interconnection may be effected between the terminal 10 and a backplane on the substrate. It should be understood that is within the contemplation of the present invention to arrange the legs 46 such that they align parallel to the reference axis 10A of the terminal. Such an arrangement is suggested in dot-dash lines in FIG. 6.

The terminal 10 is formed from the blank B shown in developed view in FIG. 6. The blank B is attached to a carrier strip (not shown) by a tail T. The blank is made by a stamping operation and the terminal 10 is formed therefrom by bending the blank over a mandrel, as is understood by those skilled in the art.

Figure 8:
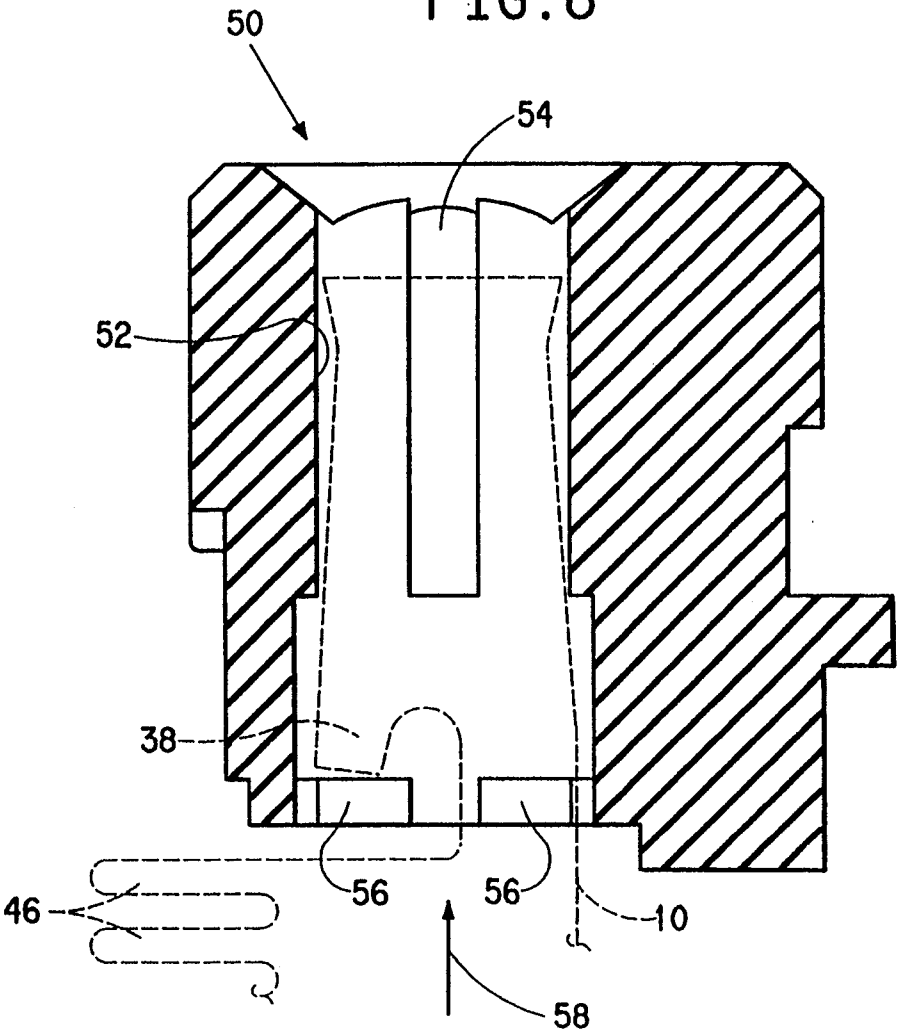
FIGS. 7 and 8 are, respectively, an isolated perspective view and a side elevational view (in section) of a housing adapted to accept the terminal of FIGS. 1 through 6.
Figure 7:
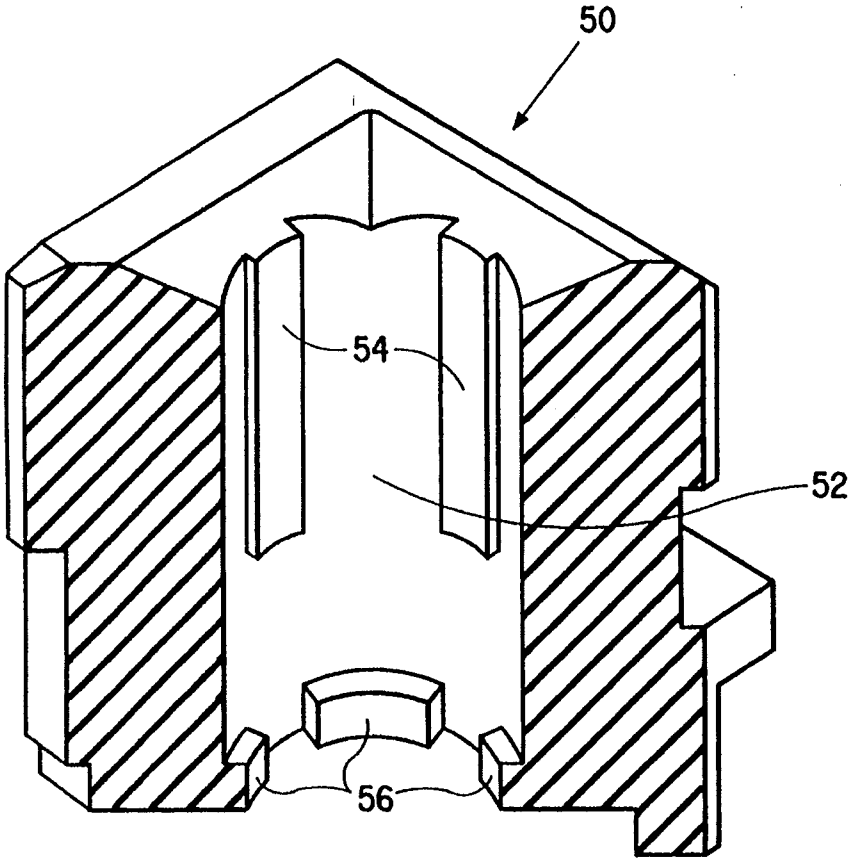

With reference to FIGS. 7 and 8 the terminal 10 is received within a housing 50 formed from a block of a suitable insulating material. The housing 50 has an through passage 52 therein. Locating guide members 54 extend axially along the walls of the passage 52 to position the terminal 10 (shown in dot-dash lines in FIG. 8) within the housing. Locking ribs 56 are disposed about the open end of the passage 52. The terminal 10 is inserted into the passage 52 in the housing 50 in the direction of the arrow 58. The latches 38 on the beams 20 are resiliently deflected as the terminal 10 is inserted into the housing 50. Once axially past the locking ribs 54 the latches 38 snap into locking position behind the locking ribs 56. The circumferential extent of the locking ribs 54 is such that the tabs 38 will engage against a rib 54 to retain the terminal 10, once inserted, within the housing 50.

Since the dimension 36 of the surface 28 is the most constricted dimension of the socket a terminal 10 in accordance with the present invention presents no impediment to the axial advance of a male pin. Thus a pin having any desired length may be received coaxially with the reference axis of the terminal. Such a capability is believed advantageous when using the terminal of the present invention in a so-called "first break-last break" interconnection system.

Those skilled in the art having the teachings of the present invention as hereinabove set forth may effect numerous modifications thereto. It should be understood that such modifications lie within the contemplation of the present invention as defined by the appended claims.

What is claimed is:

1. A female-type power port terminal for connecting to a male lug of a wide range of lengths and cross-sectional dimensions, comprising:

a contact receiving portion having a web and a plurality of fingers that are unitary with said web, said fingers being arranged to form an axially extending socket that is aligned about a reference axis, each of said fingers having a free end that is distal from said web, said free ends being unconnected to each other except through said web, each of said fingers further having a bend therein proximate said free end, said bends together defining a contact surface that is constructed and arranged to contact a male plug that is inserted into said socket, said contact surface being the most constricted point along said reference axis in said terminal; and a mounting portion that is unitary with and extends longitudinally from said contact receiving portion and is formed together with said contact receiving portion from a single blank of conductive material, said mounting portion comprising a hood region that is curved about said reference axis by substantially 270 degrees to define a space that is coextensive and aligned with said socket, said hood region being open at least to permit a plug to pass into said space, said mounting portion further comprising a plurality of mounting legs thereon for mounting the terminal on a substrate;

whereby said terminal, as a result of said unconnected free ends, is constructed to accept male plugs within a wide range of cross-sectional dimensions, and, as a result of said open space defined by said hood portion, is constructed to accept a male plug of a wide range of lengths.

2. The power port terminal of claim 1 wherein the mounting legs extend generally perpendicularly to the reference axis.

3. The power port terminal of claim 1 wherein the mounting legs extend generally parallel to the reference axis.

4. The power port terminal of claim 3 wherein at least one of the beams has a latch tab thereon.

5. The power port terminal of claim 3 wherein at least two of the beams has a latch tab thereon.

6. The power port terminal of claim 2 wherein at least one of the beams has a latch tab thereon.

7. The power port terminal of claim 2 wherein at least two of the beams has a latch tab thereon.

8. The power port terminal of claim 1 wherein at least one of the beams has a latch tab thereon.

9. The power port terminal of claim 1 wherein at least two of the beams has a latch tab thereon.

10. A female-type power port terminal for connecting to a male lug of a wide range of lengths and cross-sectional dimensions, comprising:

a contact receiving portion having a web and a plurality of fingers that are unitary with said web, said fingers being arranged to form an axially extending socket that is aligned about a reference axis, each of said fingers having a free end that is distal from said web, said free ends being unconnected to each other except through said web, each of said fingers further having a bend therein proximate said free end, said bends together defining a contact surface that is constructed and arranged to contact a male plug that is inserted into said socket, said contact surface being the most constricted point along said reference axis in said terminal; and a mounting portion that is unitary with and extends longitudinally from said contact receiving portion and is formed together with said contact receiving portion from a single blank of conductive material, said mounting portion comprising a hood region that is curved about said reference axis to define a space that is coextensive and aligned with said socket, said hood region being open at least to permit a plug to pass into said space, said mounting portion further comprising at least three mounting legs thereon form mounting the terminal on a substrate, said mounting legs each extending downwardly a substantial distance below said contact receiving portion;

whereby said terminal, as a result of said unconnected free ends, is constructed to accept male plugs within a wide range of cross-sectional dimensions, and, as a result of said open space defined by said hood portion, is constructed to accept a male plug of a wide range of lengths.

* * * * *